United States Patent [19]

Del Vecchio et al.

[11] Patent Number: 4,457,402

[45] Date of Patent: Jul. 3, 1984

[54] WHEELCHAIR LIFT

[75] Inventors: Joseph A. Del Vecchio, East Providence, R.I.; Kenneth L. Hunnibell, Rehoboth, Mass.; Christopher G. Ladewig, Providence; Mark S. Harrison, Portsmouth, both of R.I.

[73] Assignee: Lipstep Design Group Corp., East Providence, R.I.

[21] Appl. No.: 372,292

[22] Filed: Apr. 27, 1982

[51] Int. Cl.[3] ..... B66B 9/06

[52] U.S. Cl. ..... 187/12; 280/166; 105/449; 414/921

[58] Field of Search ..... 187/8.71, 8.72, 18, 187/12, 9 R; 414/921, 540; 182/141, 69; 280/163, 166; 105/447, 443, 449

[56] References Cited

U.S. PATENT DOCUMENTS 4,285,416 8/1981 Dudynskyj ..... 414/921

FOREIGN PATENT DOCUMENTS 1349760 4/1974 United Kingdom ..... 280/166

*Primary Examiner*—Joseph J. Rolla
*Assistant Examiner*—Kenneth Noland
*Attorney, Agent, or Firm*—Salter & Michaelson

[57] ABSTRACT

A wheelchair lift operable to transport handicapped persons between a lower level and an upper level. The apparatus includes an elevator platform and a plurality of vertically movable stair members. When the platform is in its lower position, the stair members form a conventional stairway which extends between lower and upper surfaces; and when the platform is moved upwardly, a collecting member attached thereto sequentially collects the stair members and moves them upwardly until the platform and stair members are coplanar with the upper surface. A normally open safety gate on the platform is automatically moved to and retained in a closed position whenever the platform is raised above the lower surface.

11 Claims, 13 Drawing Figures

FIG. 7
FIG. 13
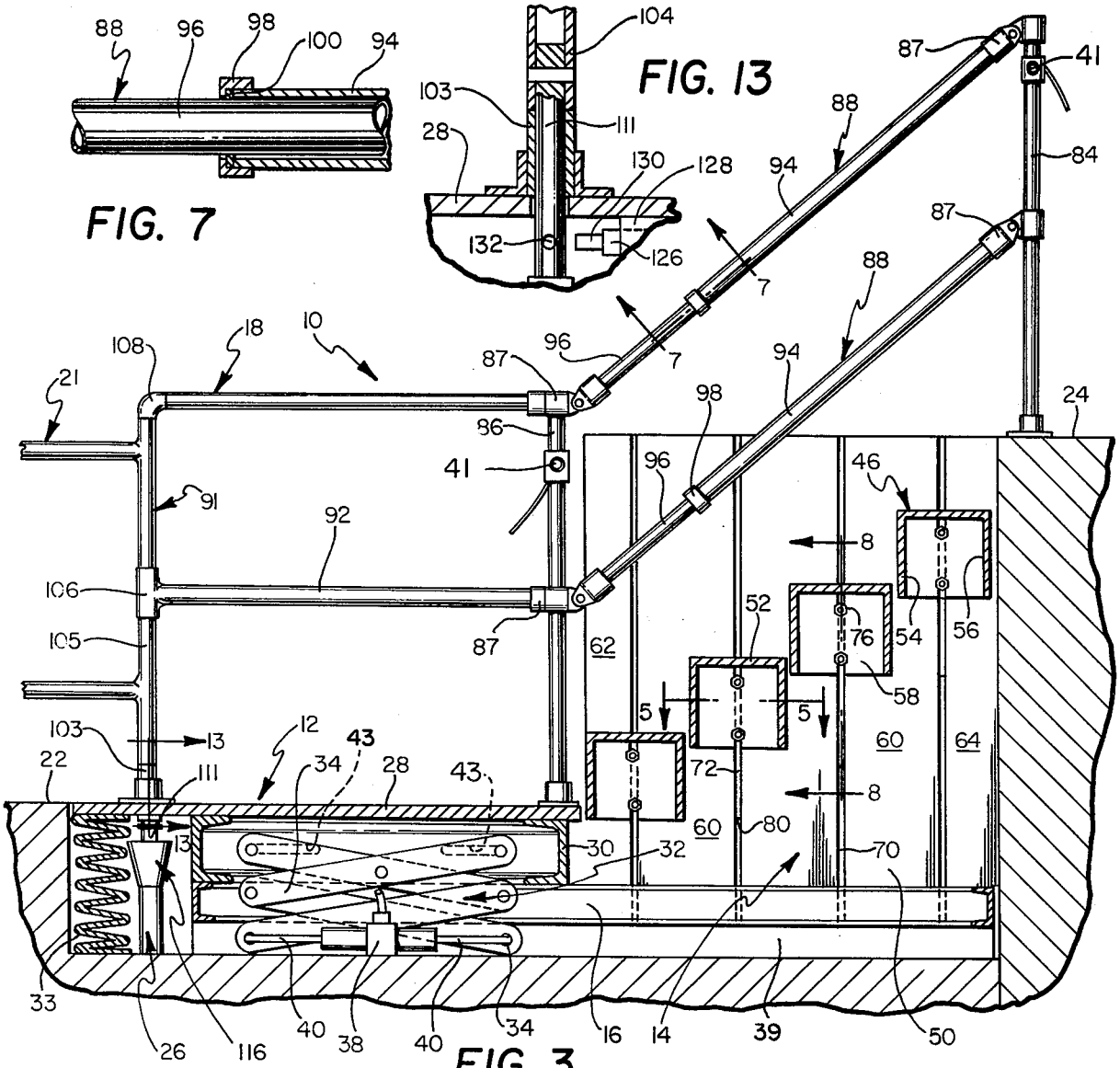
FIG. 3
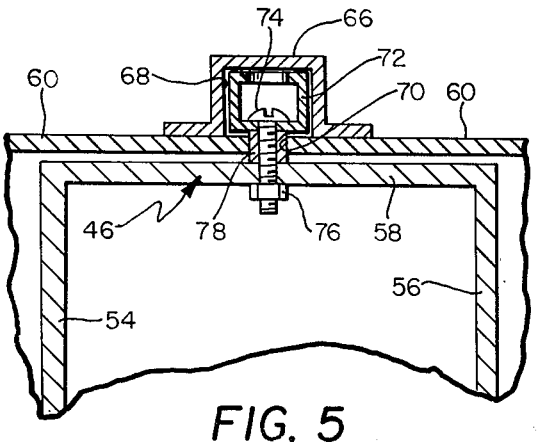
FIG. 5
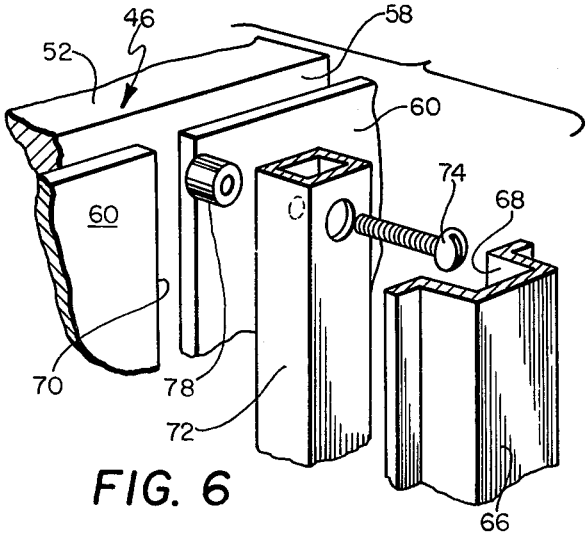
FIG. 6

WHEELCHAIR LIFT

BACKGROUND AND SUMMARY OF THE INVENTION

The instant invention relates to devices for facilitating the entry of handicapped persons to buildings or vehicles having access stairways, and more particularly to a combination elevator platform-stairway apparatus which is selectively operable as a conventional stairway or as an elevator platform to transport handicapped persons between a lower supporting surface and an upper supporting surface.

In recent years there has generally been an increase in the concern and awareness regarding the difficulties encountered by handicapped persons in performing their normal daily activities. In this connection, increased emphasis has been placed on assisting handicapped persons to achieve maximum mobility and independence. For this reason, many curbing sections of city sidewalks have been adapted with ramps to accomodate wheelchairs and the like. Handicapped parking has also been provided in many parking areas. Nevertheless, stairways which are negotiated as a matter of course by non-handicapped persons still present major obstacles to handicapped persons, particularly those confined to wheelchairs and the like.

Devices representing the closest prior art to the instant invention of which the applicants are aware are illustrated in the U.S. patents to GLASSER, U.S. Pat. No. 3,661,228, ADAMSKI et al, U.S. Pat. No. 4,029,223, THORLEY, U.S. Pat. No. 4,081,091, POLI, U.S. Pat. No. 4,168,134, ROTH et al, U.S. Pat. No. 4,180,366, THORLEY, U.S. Pat. No. 4,251,179, KAJITA, U.S. Pat. No. 4,273,217 and DUDYNSKYJ, U.S. Pat. No. 4,285,416. While all of these patents relate to wheelchair lift devices for assisting the mobility of handicapped persons, particularly those confined to wheelchairs, they do not disclose or teach a device where, as per the device of the instant invention, a plurality of individual stair members are vertically slidable between lower positions wherein they cooperate to define a stairway and upper positions wherein the upper surfaces thereof are substantially coplanar. The above patents also do not teach the concept of providing an elevator platform having a collector frame which extends therefrom and operates to collect the stair members to move same to their upper positions or a device having a safety gate which automatically closes when the platform thereof commences to move to an elevated position. Hence, none of the above patents teach or suggest the basic concept or spirit of the instant invention as set forth herein.

Specifically, the instant invention provides a novel combination elevator platform-stairway construction which is usable by both handicapped and non-handicapped persons. In particular, the device of the instant invention includes a platform portion which is automatically movable between a first lower position wherein it is substantially coplanar with a lower supporting surface and a second upper position wherein it is substantially coplanar with an upper supporting surface. The apparatus includes a plurality of individual stair members which are mounted so that when the platform is in its lower first position, they define a stairway which leads from the platform to the upper supporting surface. The stair members are individually mounted in a vertically slidable manner whereby they are movable to positions wherein the upper surfaces thereof are substantially coplanar with the upper supporting surface. Also included in the apparatus is a collecting member which extends rearwardly from the platform beneath the stair members. Upon movement of the platform from its lower first position to its upper second position, the collecting member sequentially engages the stair members starting with the lowermost one and collects them to move them to positions wherein the upper surfaces thereof are substantially coplanar with the upper supporting surface. Accordingly, when the platform is in its upper second position, it is substantially coplanar with the upper supporting surface and the upper surfaces of all of the stair members whereby a wheelchair or the like on the platform jmay be easily wheeled onto the upper supporting surface. Similarly, as the platform is moved from its upper second position to its lower first position, the collecting member sequentially deposits the stair members in the respective lower positions thereof so that when the platform reaches its lower first position they once again define a stairway of conventional configuration which leads between the platform in its lower position and the upper supporting surface. To assure the safety of persons in wheelchairs or the like on the platform when it is rising and/or is in an elevated position, a safety railing is provided thereon which includes telescoping side railing members which automatically adjust in length as the platform is raided or lowered. A safety gate which automatically opens when the platform is in its lower first position cooperates with the side railings to completely enclose the platform and an automatic closing mechanism on the apparatus automatically closes the safety gate and retains it in a closed position as the platform is raised to an elevated disposition.

Accordingly, it is a primary object of the instant invention to provide a combination elevator-platform stairway which is operable to transport handicapped persons between a lower supporting surface and an upper supporting surface.

Another object of the instant invention is to provide an elevator-platform stairway construction which is alternatively operable as a conventional stairway or as an elevator platform for transporting persons, articles and the like between a lower supporting surface and an upper supporting surface.

Another object of the instant invention is to provide an elevator platform-stairway construction having safety railings and a safety gate which is automatically closed as the platform thereof is raised to an elevated position.

Other objects, features and advantages of the invention shall become apparent as the description thereof proceeds when considered in connection with the accompanying illustrative drawings.

DESCRIPTION OF THE DRAWINGS

In the drawings which illustrate the best mode pesently contemplated for carrying out the present invention:

FIG. 3 is a side elevational view taken along line 3—3 in FIG. 1;

FIG. 5 is an enlarged sectional view taken along line 5—5 in FIG. 3;

FIG. 6 is an enlarged exploded perspective view of the channel and slide members used to slidingly mount the stair members;

FIG. 7 is an enlarged sectional view taken along line 7—7 in FIG. 3;

FIG. 13 is an enlarged sectional view taken along line 13—13 in FIG. 3.

DESCRIPTION OF THE INVENTION

Figure 1:
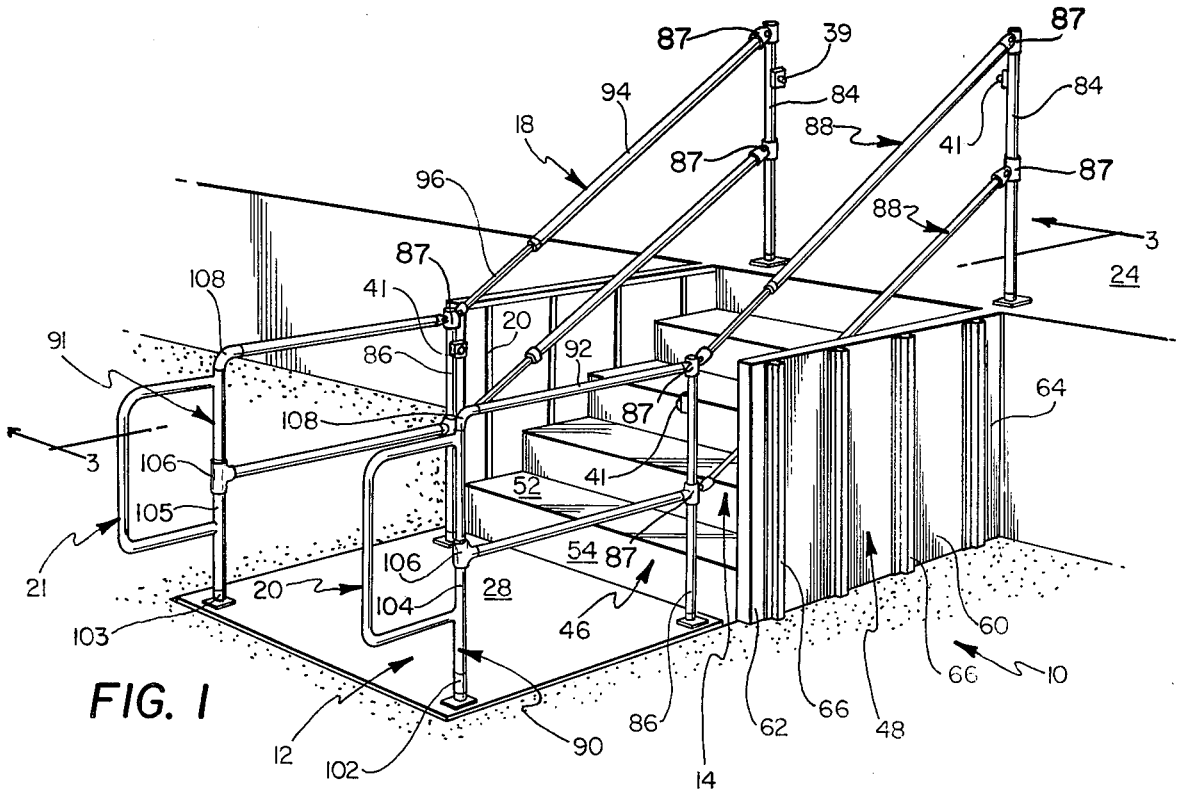
FIG. 1 is a perspective view of the apparatus of the instant invention in its lower position.

Referring now to the drawings, the combination elevator platform-stairway apparatus of the instant invention is generally indicated at 10 in FIGS. 1 through 4. The apparatus 10 generally comprises an elevator platform portion 12, a stairway portion 14, a stair member collector frame 16, a safety railing assembly 18, and a pair of automatic safety gates 20 and 21. The apparatus is operable to transport persons, articles and the like between a lower supporting surface 22 which may be ground level and an upper supporting surface 24. An automatic gate closing mechanism generally indicated at 26 operates to automatically move the safety gates 20 and 21 from open positions thereof to closed positions thereof when the platform portion 12 is raised above the level of the lower supporting surface 22 to assure the safety of persons utilizing the apparatus 10, particularly when the person is in a wheelchair.

Figure 4:
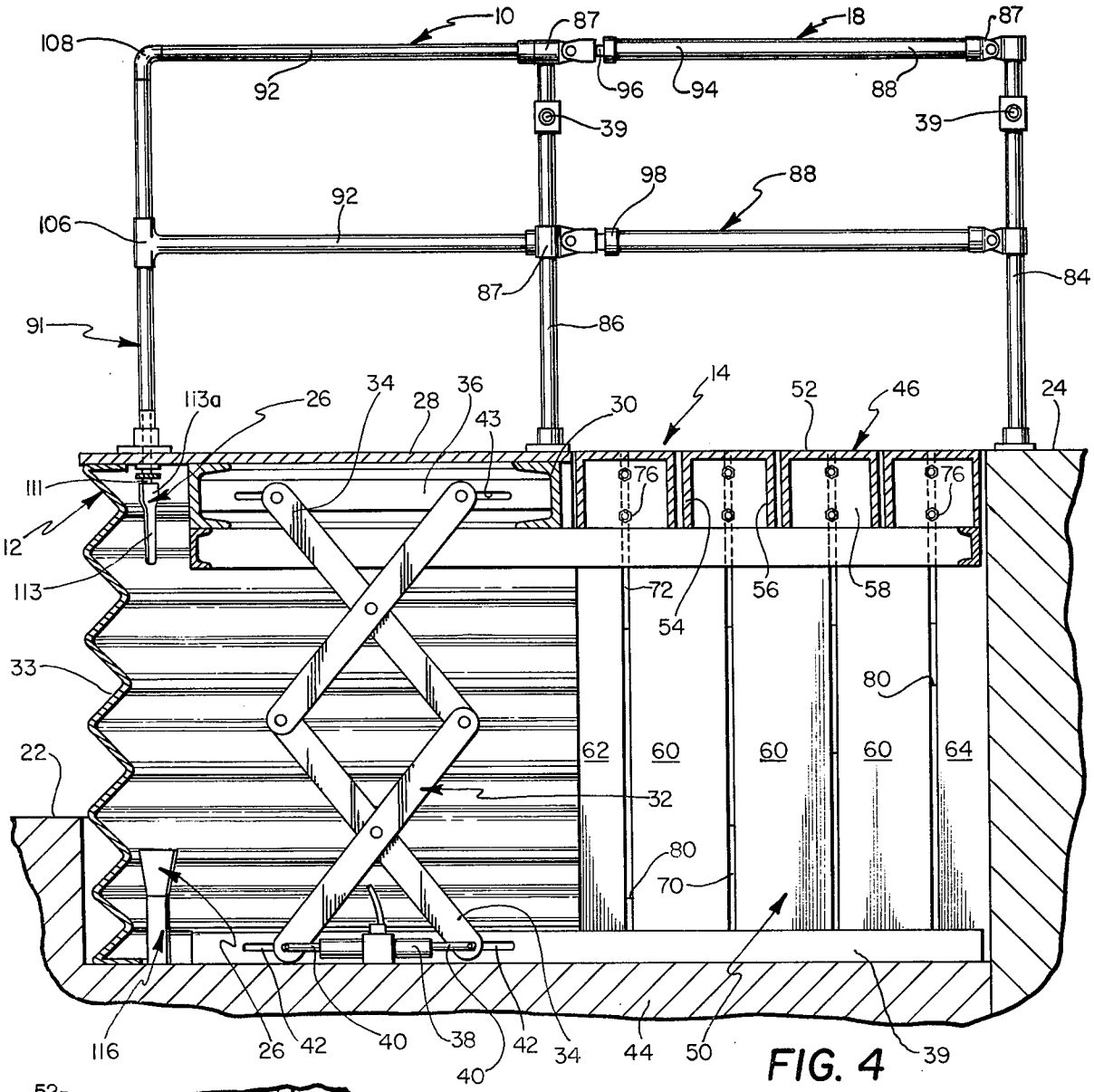
FIG. 4 is a similar view taken along line 4—4 in FIG. 2.

As will be seen most clearly from FIGS. 3 and 4, the elevator platform portion 12 generally comprises a rigid upper support plate 28 which defines the upper surface of the platform portion 12, a support frame 30, a lifting assembly generally indicated at 32 and a collapsible accordion-like safety housing 33. The support frame 30 is secured to the underside of support plate 28 and comprises a plurality of channel beam members which are joined together at the ends thereof to define a rigid frame of substantially rectangular configuration which supports the plate 28. The lifting assembly 32 comprises a plurality of pivotally connected links 34, an upper lifting table 36 and a hydraulic assembly 38 mounted on a base 39 having piston rods 40 activated by switches 41 mounted on the railing assembly 18. The links 34 are pivotally interconnected in a scissors-like manner to define a conventional "scissors-type" lifting assembly. The lower ends of the lowermost members 24 are pivotally secured to the piston rods 40 and slidably engage within horizontal slots 42 in the base 39 while the upper ends of the uppermost members 34 are pivotally secured to the table 36 in slidable engagement with horizontal slots 43 therein. The table 36 is captured within the support frame 30 and the base 39 is mounted on a lower foundation 44 which is preferably made of concrete or some other suitable firm foundation material. Accordingly, upon activation of the hydraulic assembly 38 by one of the switches 41, the lower ends of the lowermost members 34 and upper ends of the uppermost members 34 are alternatively separated or drawn together as desired whereby the members 34 cooperate in a scissors-like manner to alternatively lower or raise the table 36 and the support plate 28. It is understood, however, that the lifting assembly 32 in itself does not comprise part of the instant invention and that other embodiments of the invention which incude lifting assemblies of other types and configurations are contemplated.

The stairway assembly 14 includes a plurality of individual stair members 46 and a pair of spaced mounting walls 48 and 50 between which the stair members 46 are mounted in a vertically slidable manner. The stair members 46 comprise top walls 52 which may include stair treads of various configuration, front and rear walls 54 and 56, respectively, and end walls 58. The mounting walls 48 and 50 are defined by elongated central vertical panels 60, elongated front and rear vertical panels 62 and 64, respectively, of reduced widths, and elongated channel members 66 which interconnect the panels 60, 62 and 64. In this connection, as will be seen most clearly from FIGS. 5 and 6, the channel members 66 which define inner channels 68 of substantially rectangular cross section are secured to adjacent panels 60 so that the adjacent edges thereof define vertical slots 70 which are of smaller sectional dimension than the adjacent channels 68, but which are in communication therewith. Similar slots 70 are defined by the interconnection of the panels 60 with the panels 62 and 64. The stair members 46 are mounted on the walls 48 and 50 with slides 72 of rectangular cross section which are dimensioned to travel within the channels 68. Threaded screws 74 and threaded nuts 76 cooperate to secure the slides 72 to the stair members 46 with spacer bushings 78 which are received on the screws 74 and interposed between the stair members 46 and the slides 72 so that said bushings are free to travel up or down in the grooves 70.

Figure 8:
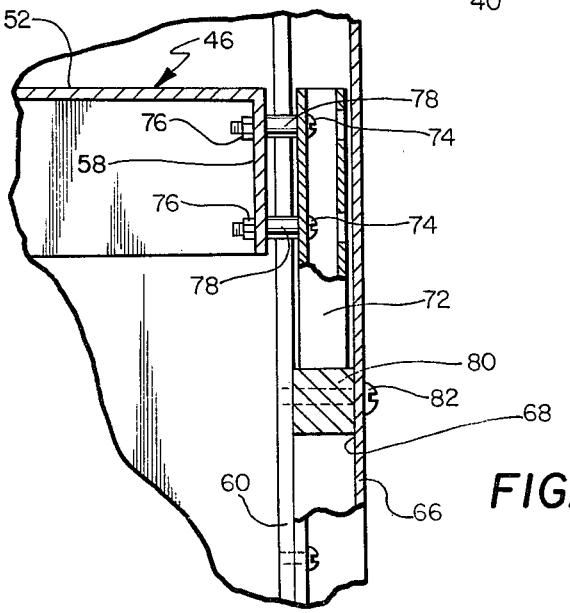
FIG. 8 is an enlarged sectional view taken along 8—8 in FIG. 3.
Figure 9:
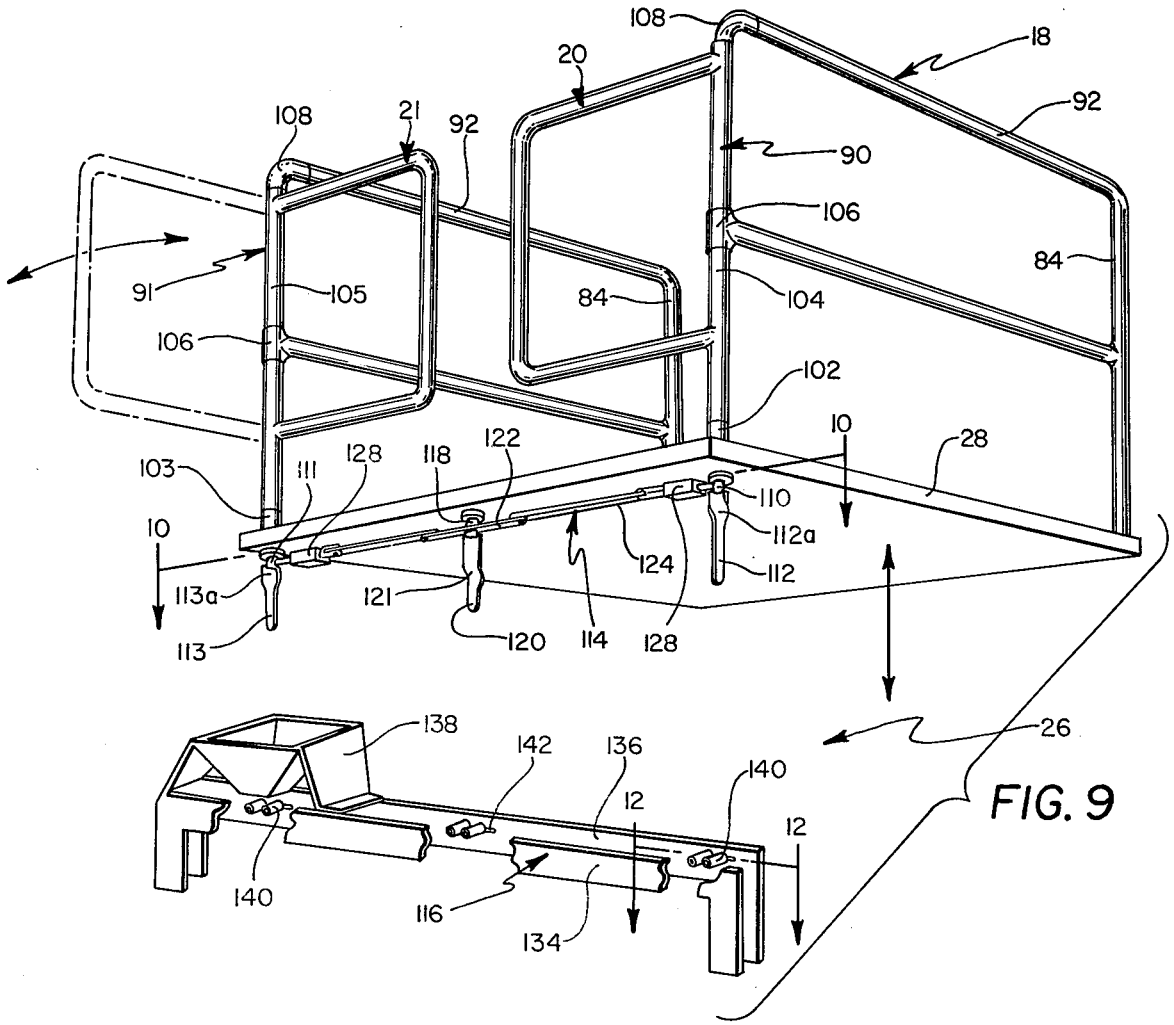
FIG. 9 is an exploded perspective view illustrating the mechanism utilized for automatically opening and closing the safety gate.
Figure 10:
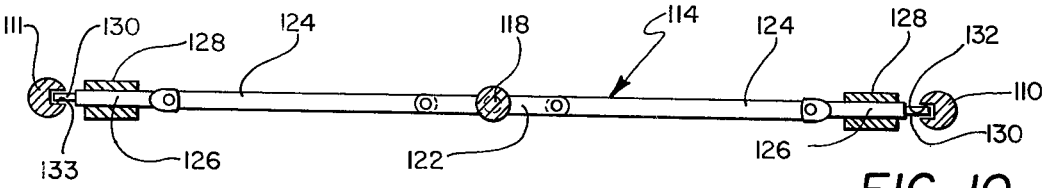
FIG. 10 is an enlarged sectional view taken along line 10—10 in FIG. 9.
Figure 11:
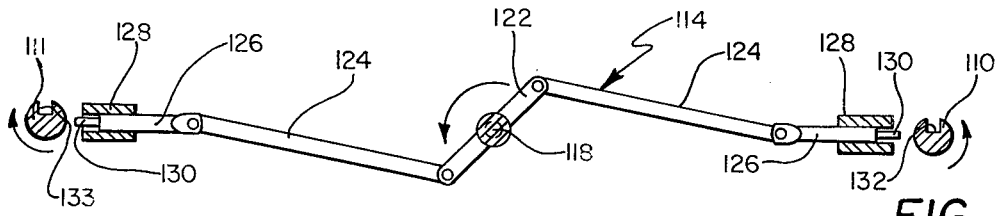
FIG. 11 is a similar view with the gate mechanism in its open position.
Figure 12:
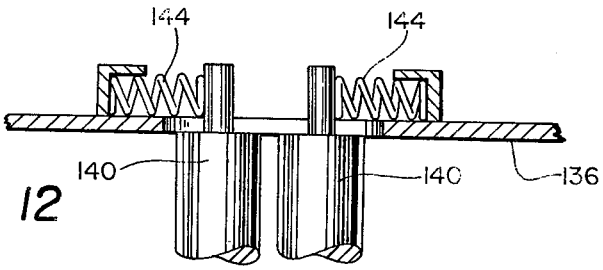
FIG. 12 is an enlarged sectional view taken along line 12—12 in FIG. 9.

The stair members 46 are mounted in the above-described manner on the mounting walls 48 and 50 so that they are vertically movable between lower first positions thereof wherein the top walls 52 thereof cooperate to define a conventional stairway extending from the lower supporting surface 22 to the upper supporting surface 24, and second upper positions thereof wherein the top walls 52 thereof are substantially coplanar with the upper supporting surface 24. In this regard, as shown most clearly in FIG. 8, stop posts 80 are secured in each of the channels 68 with screws 82 to limit the downward sliding movement of the respective slide 72 and thereby individually define the lowermost positions of the stair members 46 so that they cooperate to define a stairway as hereinabove described. Further in this regard, it has been found preferable for the slide 72 to be dimensioned so that they are substantially longer than the heights of their respective stair members 46 so as to minimize canting thereof due to tolerances in the channels 68 and hence the stop posts 80 are positioned accordingly.

The collector frame 16 is of substantially rectangular configuration and is defined by a plurality of channel beams which are secured together at the ends thereof. The frame 16 is secured to the underside of the support frame 30 and extends rearwardly therefrom beneath all of the stair members 46.

Figure 2:
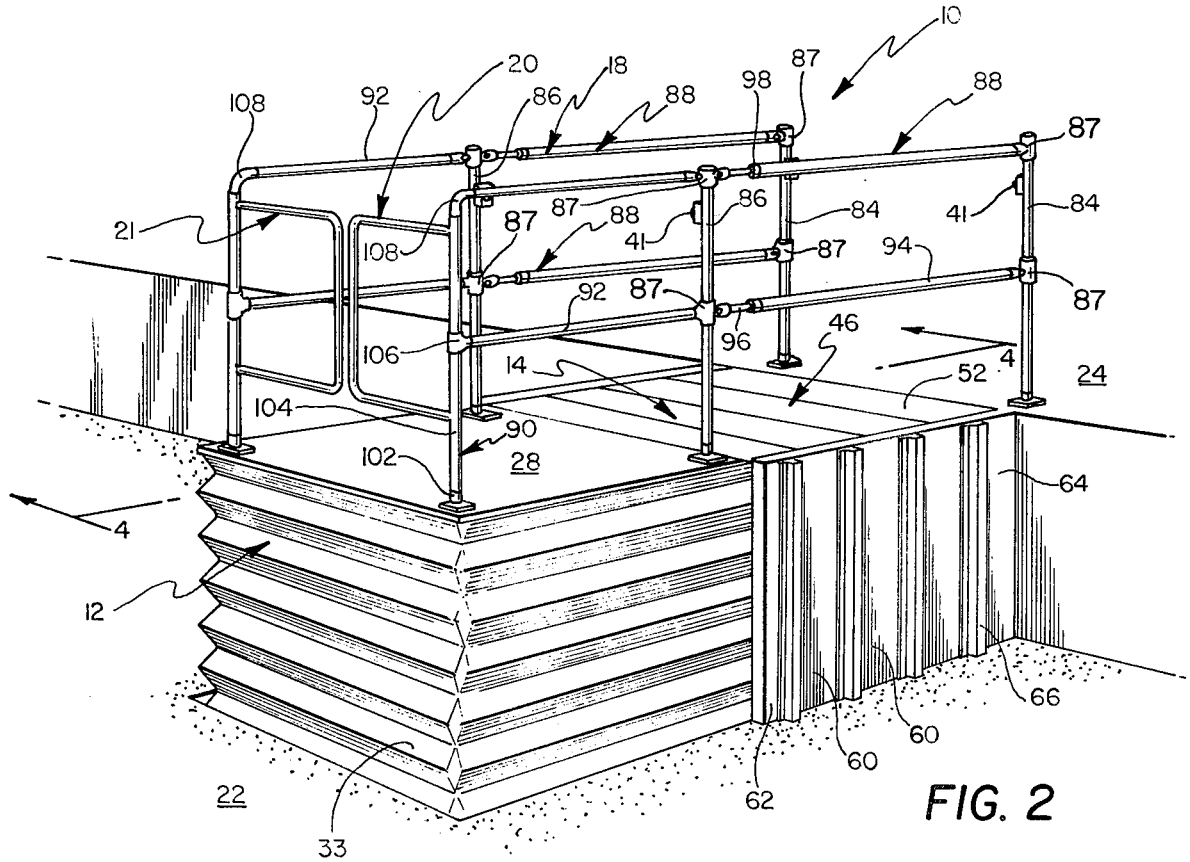
FIG. 2 is a perspective view thereof in its upper position.

It will therefore be seen that the apparatus 10 is operable between a lower first position wherein the platform portion 12 thereof is substantially coplanar with the lower supporting surface 22 and wherein the stair members 46 cooperate to define a conventional stairway which leads generally to the upper surface 24 as illustrated in FIGS. 1 and 2, and an upper second position wherein the platform portion 12 and the top walls 52 of the stair members 46 are all substantially coplanar with the upper supporting surface 24, as illustrated in FIGS. 2 and 4. When the apparatus 10 is in its lower position the stair members 46 are supported in their respective channels 68 by their respective slide members 72 which engage their respective stop posts 80. However, when the hydraulic assembly 38 is activated to retract the piston rods 40, the lifting assembly 32 raises the support frame 30 and the top plate 28. Simultaneously, the lifting assembly 32 also raises the collector frame 16 whereby the frame 16 sequentially engages and "collects" the stair members 46 commencing with the lowermost one thereof and moves them to the upper positions thereof illustrated in FIGS. 2 and 4 wherein the top walls 52 thereof are substantially coplanar with the support plate 28 and the upper supporting surface 24. Similarly, upon outward movement of the piston rods 40 to cause the separation of the lower ends of the link members 34, the lifting assembly 32 descends and the collecting member 16 sequentially deposits the stair members 46 as the respective slides 72 thereof engage the respective stop posts 80 whereby the stair members 46 once again cooperate to define a stairway.

The safety housing 33 is alternatively expandable or contractible upon upward or downward movement, respectively, of the portion 12 to fully enclose the assembly 32 for safety reasons.

The railing assembly 18 comprises upper and lower substantially vertical stairway railing posts 84 and 86, respectively, telescoping railings generally indicated at 88, gate posts generally indicated at 90 and 91 and platform side railings 92. The posts 84 and 86 are mounted on the upper supporting surface 24 and the support plate 28, respectively, and the railings 88 are pivotally secured to the posts 84 and 86 as at 87 and extend therebetween. The posts 90 and 91 are secured to the plate 28 adjacent opposite front corners thereof and the railings 92 extend from the posts 86 to the posts 90 and 91. The telescoping railings 88 comprise enlarged outer sleeves 94 and reduced inner rails 96 which are slidingly received in the sleeves 94, whereby the railings 88 are automatically contractible or expandable as the platform 12 is moved upwardly or downwardly, respectively. As shown most clearly in FIG. 7, collars 98 on the sleeves 94 retain seals 100 in sealing engagement with the exterior surfaces of the rails 96 to prevent moisture leakage between the sleeves 94 and the rails 96. Further in this regard, the railings 88 are mounted so that the sleeves 94 define the upper ends thereof to reduce the tendency for water to gravitate past the seals 100.

The posts 90 and 91 define an accessway to the platform portion 12 and comprise fixed base portions 102 and 103, respectively, and rotatable gate portions 104 and 105, respectively. The gate portions 104 and 105 are rotatably received in T members 106 at intermediate portions in the extents thereof and elbows 108 at the upper ends thereof whereby the railings 92 are secured to the posts 90 and 91 whereby the gates 20 and 21 which extend from the gate portions 104 and 105, respectively, are rotatable between closed positions wherein they obstruct access to the platform portion 12, and open positions wherein they extend outwardly from the railing assembly 18 and permit access to the platform portion 12.

The automatic gate closing assembly 26 is most clearly illustrated in FIGS. 9 through 13. The assembly 26 includes gate shafts 110 and 111 which extend downwardly form the gate portions 104 and 105, respectively, through the fixed portions 102 and 103, respectively, and the support plate 28 and rotate with the gate portions 104 and 105, respectively, and substantially right angle helical bayonets 112 and 113 which extend downwardly from the shafts 110 and 111 and include helical portions 112*a* and 113*a*, respectively. The assembly 26 also includes a gate latching or locking assembly 114, and a bayonet receiving assembly 116.

The locking assembly 114 includes a locking bayonet shaft 118 which is rotatably mounted and extends downwardly from the support plate 28 between the shafts 110 and 111, a substantially right angle elongated helical locking bayonet 120 having a helical portion 121 which is disposed slightly lower than either of the helical portions 112*a* or 113*a*. The bayonet 120 extends downwardly from the shaft 118 and a pivot bar 122 is mounted on the shaft 118 and pivots upon rotation thereof. Linkage arms 124 which are pivotally secured to the ends of the bar 112, slides 126 which are slidably mounted in blocks 128 which are secured to the lower side of the support plate 28, and bolts 130 which extend from the slides 126 are also included in the assembly 114. Grooves 132 and 133 are provided in the gate shafts 110 and 111, respectively, being disposed thereon so that they are directed substantially inwardly when the gates 20 and 21 are in the closed positions thereof. Accordingly, the assembly 114 is operable between the locked position thereof illustrated in FIG. 10 wherein the bolts 130 and 131 are received in the grooves 132 and 133, respectively, to prevent rotation of the shafts 110 and 111, respectively, and opening of the gates 20 and 21, respectively, and the unlocked position thereof illustrated in FIG. 11 wherein the locking bayonet shaft 118 has been rotated so that the linkage arms 124 and the slides 126 are drawn inwardly and the bolts 130 are withdrawn from the grooves 132 and 133 whereby the gates 120 are movable to the open positions thereof.

The bayonet receiving assembly 116 is preferably mounted on the foundation 44 and includes spaced front and rear frame members 134 and 136, respectively, which are interconnected with three funnel members 138 of generally rectangular section which open generally upwardly. Pairs of guide rollers 140 which are mounted in slots 142 on the rear frame member 136 and which are biased together with springs 144 are disposed beneath each of the three funnel members 138. The assembly 116 is disposed beneath the front portion of the platform portion 12 whereby upon downward movement of the platform portion 12 to the lower position thereof, the three bayonets 112, 113, and 120 are received in the three respective funnel members 138 therebeneath and thereby guided between the respective pairs of rollers 140. Accordingly, as the bayonets 112, 113 and 120 are inserted between the pairs of rollers 140, the helical portions 112*a*, 113*a* and 121 thereof are engaged by the rollers 140 to cause rotation of the shafts 110, 111, and 118, respectively, in the manner illustrated in FIG. 11. Since the bayonet 120 is slightly longer than either of the bayonets 112 or 113, upon downward movement of the platform portion 12, rotation of the shaft 118 is effected slightly before rotation of either of the shafts 110 or 111 is commenced so that the bolts 130 are disengaged before movement of the shafts 110 and 111 is commenced. In this regard, it is obvious that the helical portions 112*a* and 113*a* are of opposite rotation in order to effect the desired gate movement, i.e., they are adapted so that counterclockwise rotation is effected with the portion 112*a* and clockwise rotation is effected with the portion 113*a* upon downward movement of the platform portion 12. Upon upward movement of platform portion 12 from the lower position thereof, rotation is effected by means of the helical portions 112*a* and 113*a* in the opposite directions to close the gates 20 and 21 and thereafter rotation of the helical portion 121 is effected to activate the locking assembly 114 and thereby retain the gates 20 and 21 in the closed positions thereof.

It is seen therefore that the instant invention provides a novel and effective apparatus which is alternatively operable as a stairway or as an elevator platform assembly capable of transporting handicapped persons and the like between a lower supporting surface and an upper supporting surface. The apparatus provides substantially increased mobility for handicapped persons and eliminates the necessity for having a separate elevator and stairway facilities for handicapped persons and non-handicapped persons. Further the apparatus is extremely safe and is simple to operate by making it practical for a wide variety of applications. Consequently, the apparatus of the instant invention represents a significant advancement in the art and has significant commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination elevator platform-stairway apparatus which is operable to transport persons, articles and the like between a lower supporting surface and an upper supporting surface comprising:

a. a stair member having an upper surface thereon;

b. a platform having an upper surface thereon adjacent to said stair member;

c. means for moving said platform between a first position wherein the upper surface thereof is substantially coplanar with said lower supporting surface and a second position wherein the upper surface thereof is substantially coplanar with said upper supporting surface;

d. means mounting said stair member so that it is vertically slidable between a lower position thereof wherein it forms a step between said platform surface and said upper supporting surface when said platform is in said first position and an upper position thereof wherein the upper surface thereof is substantially coplanar with said upper supporting surface; and e. means for slidably moving said stair member vertically in said stair member mounting means so that said stair member is moved to the upper position thereof when said platform is moved to said second position.

2. The apparatus of claim 1, further comprising a plurality of said stair members, said stair member mounting means mounting said stair members so that they are individually vertically slidable between lower positions thereof wherein they form a stairway between said platform and said upper supporting surface when said platform is in said first position and upper positions thereof wherein the upper surfaces thereof are all substantially coplanar with said upper supporting surface, said stair member moving means moving all of said stair members to the upper positions thereof.

3. In the apparatus of claim 1, said stair member moving means further characterized as means extending from said platform and engaging said stair member to move same to the upper position thereof when said platform is moved to said second position.

4. In the apparatus of claim 2, said stair member moving means further characterized as means extending from said platform and sequentially engaging said stair members commencing with the lowermost thereof to collect same and move them to upper positions thereof when said platform is moved to said second position.

5. A combination elevator platform-stairway apparatus which is operable to transport persons, articles and the like between a lower supporting surface and an upper supporting surface comprising:

a. a stair member having an upper surface thereon;

b. a platform having an upper surface thereon adjacent to said stair member;

c. means for moving said platform between a first position wherein the upper surface thereof is substantially coplanar with said lower supporting surface and a second position wherein the upper surface thereof is substantially coplanar with said upper supporting surface;

d. means mounting said stair member so that it is vertically slidable between a lower position thereof wherein it forms a step between said platform surface and said upper supporting surface when said platform is in said first position and an upper position thereof wherein the upper surface thereof is substantially coplanar with said upper supporting surface;

e. means for moving said stair member to the upper position thereof when said platform is moved to said second position;

f. a first railing post attached to said platform and extending upwardly therefrom;

g. a second railing post attached to said upper supporting surface and extending upwardly therefrom; and h. a telescoping hand railing member extending between said first and second posts and pivotally attached thereto in upwardly spaced relation to the respective surfaces thereof.

6. The apparatus of claim 5, further comprising:

a. side railing means on said platform defining an accessway thereon;

b. gate means on said platform movable between an open position wherein said accessway is unobstructed and a closed position wherein said accessway is obstructed;

c. means for automatically moving said gate means to said closed position when said platform is raised above said lower supporting surface and for moving said gate means to said open position when said platform is moved to a position wherein the upper surface thereof is substantially coplanar with said lower support surface; and d. means for retaining said gate in said closed position when said platform surface is above the plane of said lower supporting surface.

7. In the apparatus of claim 6, said gate means further characterized as including a pivot post, said gate means pivoting about the axis of said pivot post to move between said open and closed positions, said automatic moving means further comprising:

a. a first bayonet member having a helical portion extending substantially coaxially downwardly from said pivot post and rotating therewith;

b. means for receiving said first bayonet member and communicating with the helical portion thereof to move said gate means to said open position when said platform is moved to a position wherein the upper surface thereof is substantially coplanar with said lower supporting surface and to move said gate to said closed position when said platform is moved to a position wherein the upper surface thereof is raised above said lower supporting surface.

8. The apparatus of claim 7, further comprising a gate shaft which extends downwardly from said pivot post, and has a vertical groove channel therein and rotates therewith, said first bayonet member being attached to said shaft, said retaining means comprising:

a. a second bayonet member having a helical portion and extending downwardly from said platform;

b. means for receiving said second bayonet member and communicating with the helical portion thereof to rotate said second bayonet member upon movement of said platform when the surface thereof is proximal to said lower supporting surface;

c. latch means slidably mounted for movement between a first position wherein it is received in said groove to prevent rotation of said pivot post and a second position wherein it is withdrawn from said groove and therefore does not restrict movement of said pivot post; and e. linkage means extending between said latch means and said second bayonet member and moving said latch means to said first position thereof when said second bayonet member is rotated as said platform is moved upwardly and moving said latch means to said second position thereof when said second bayonet member is rotated as said platform is moved downwardly.

9. The apparatus of claim 5, further comprising a plurality of said stair members, said stair member mounting means mounting said stair members so that they are individually vertically slidable between lower positions thereof wherein they form a stairway between said platform and said upper supporting surface when said platform is in said first position and upper positions thereof wherein the upper surfaces thereof are all substantially coplanar with said upper supporting surface, said stair member moving means moving all of said stair members to the upper positions thereof.

10. A combination elevator platform-stairway apparatus which is operable to transport persons, articles and the like between a lower supporting surface and an upper supporting surface comprising:

a. a stair member having an upper surface thereon;

b. a platform having an upper surface thereon adjacent to said stair member;

c. means for moving said platform between a first position wherein the upper surface thereof is substantially coplanar with said lower supporting surface and a second position wherein the upper surface thereof is substantially coplanar with said upper supporting surface;

d. a pair of spaced side walls disposed adjacent opposite ends of said stair member;

e. a vertical channel member on each of said side walls adjacent the respective ends of said stair member;

f. a slide attached to each of the ends of said stair member and traveling in the respective channel member adjacent thereto;

g. means retaining said slides in their respective channel members for sliding movement therein;

h. means limiting the downward movement of said slides so that when said stair member is in its lowermost position, it defines a step between said platform and said upper supporting surface when said platform is in said first position thereof; and i. means for moving said stair member to the upper position thereof when said platform is moved to said second position.

11. In the apparatus of claim 10, said slide members being of substantially greater length than the height of said stair member to prevent canting of said stair member.

* * * * *